US006098364A

United States Patent [19]

Liu

[11] Patent Number: 6,098,364

[45] Date of Patent: Aug. 8, 2000

[54] PREFABRICATED OUTER WALL STRUCTURE WITH STRESS RUPTURE RESISTANCE

[76] Inventor: Hsin-Chin Liu, 2Fl., No. 169, Sec.2, Fu Hsing S. Rd., Taipei, Taiwan

[21] Appl. No.: 09/108,301

[22] Filed: Jul. 1, 1998

[51] Int. Cl.[7] ..... E04B 2/88

[52] U.S. Cl. ..... 52/506.08; 52/506.05; 52/506.06; 52/509; 52/511; 52/513; 52/235

[58] Field of Search ..... 52/235, 506.05, 52/506.06, 506.08, 506.09, 509, 511, 513

[56] References Cited

U.S. PATENT DOCUMENTS

| | | | |
|---|---|---|---|
| 2,218,965 | 10/1940 | Young et al. | 52/506.09 X |
| 3,342,005 | 9/1967 | Rickards | 52/509 X |
| 3,350,830 | 11/1967 | Smith et al. | 52/509 |
| 5,265,396 | 11/1993 | Amimoto | 52/509 X |

*Primary Examiner*—Robert Canfield

*Attorney, Agent, or Firm*—Donald Casey, Esq.

[57] ABSTRACT

A prefabricated outer wall structure with stress rupture resistance comprising a plurality of outer wall elements, each outer wall element comprising a wall component formed of an inner unit and a plurality of fixing components, in which the inner unit has a ladder slot and its outer surface is adhered to an outer decorative wall unit by means of adhesive in a manner that at least a retention slot is defined between the ladder slot and the outer decorative wall unit with an U-plate is placed within the retention slot; and each fixing component is connected to at least a hook plate corresponding to the U-plate in the wall component, while an end of the fixing component is secured to a construction structure so that the wall component is tightly secured to the construction structure. Thus, without damaging the wall material and the outer wall material's strength, installation can be completed with a simply procedure, and by the silicone between the inner unit and the outer decorative wall unit impact of external force, such as strong wind can be buffered to improve the fracture stress which the outer wall unit can withstand.

6 Claims, 4 Drawing Sheets

PREFABRICATED OUTER WALL STRUCTURE WITH STRESS RUPTURE RESISTANCE

BACKGROUND OF THE INVENTION

The present invention is related to a prefabricated outer wall structure with stress rupture resistance, particularly a prefabricated outer wall unit in which a silicone layer is defined between its inner material and outer decorative wall unit and a retention slot is formed between the inner material and the edge of the outer decorative wall unit, and an U-hook is placed in the retention slot for securing to a hook plate formed in a fixing component so that the fixing component is tightly secured to the construction.

SUMMARY OF THE INVENTION

Following the progress of construction method, construction of most high-rise buildings today uses prefabricated outer wall material. Generally the edge of each outer wall material (such as marble) is milled and cut with a plurality of retention slots, and by fixing of a plurality of hook plates to such outer wall material's retention slots while another ends of these hook plates are secured to the construction, the outer wall material is tightly fixed to the construction to form an outer wall. However, the said prefabricated outer wall has the following defects in fabrication or use:

1. The cutting and forming, the end of ordinary wall material becomes flat, and hence extra milling and cutting works are required to form a plurality of retention slots on each end to meet the need in forming the outer wall. This means a complicated production procedure and a need of extra time and cost.
2. The strength of the wall material is impaired by the milling and cutting, then stress is subject to concentration at the retention slots, resulting in cracking or fracture. The wall material may break at the retention slot when it is impacted by strong wind or other external force, and then, if the hook plates are disengaged, the wall material may fall down and result in injury to person or damage to property, it is hazardous to the public.

To eliminate these defect, the inventor has invented the prefabricated outer wall structure with stress rupture resistance.

Therefore, the main objective of the present invention is to provide a prefabricated outer wall structure with stress rupture resistance comprising a plurality of outer wall elements, each outer wall element comprising a wall component formed of an inner unit and a plurality of fixing components, in which the inner unit has a lateral slot and its outer surface is adhered to an outer decorative wall unit by means of adhesive in a manner that at least a retention slot is defined between the lateral slot and the outer decorative wall unit with an U-plate is placed within the retention slot; and each fixing component is connected to at least a hook plate corresponding to the U-plate in the wall component, while an end of the fixing component is secured to a construction structure so that the wall component is tightly secured to the construction structure. Thus, without damaging the wall material and the outer wall material's strength, installation can be completed with a simply procedure, and by the silicone between the inner unit and the outer decorative wall unit impact of external force, such as strong wind can be buffered to improve the fracture stress which the outer wall unit can withstand.

BRIEF DESCRIPTION OF THE DRAWINGS

The invention, as well as its many advantages, may be further understood by the following detailed description and drawing in which.

DETAILED DESCRIPTION OF THE INVENTION

Figure 1:
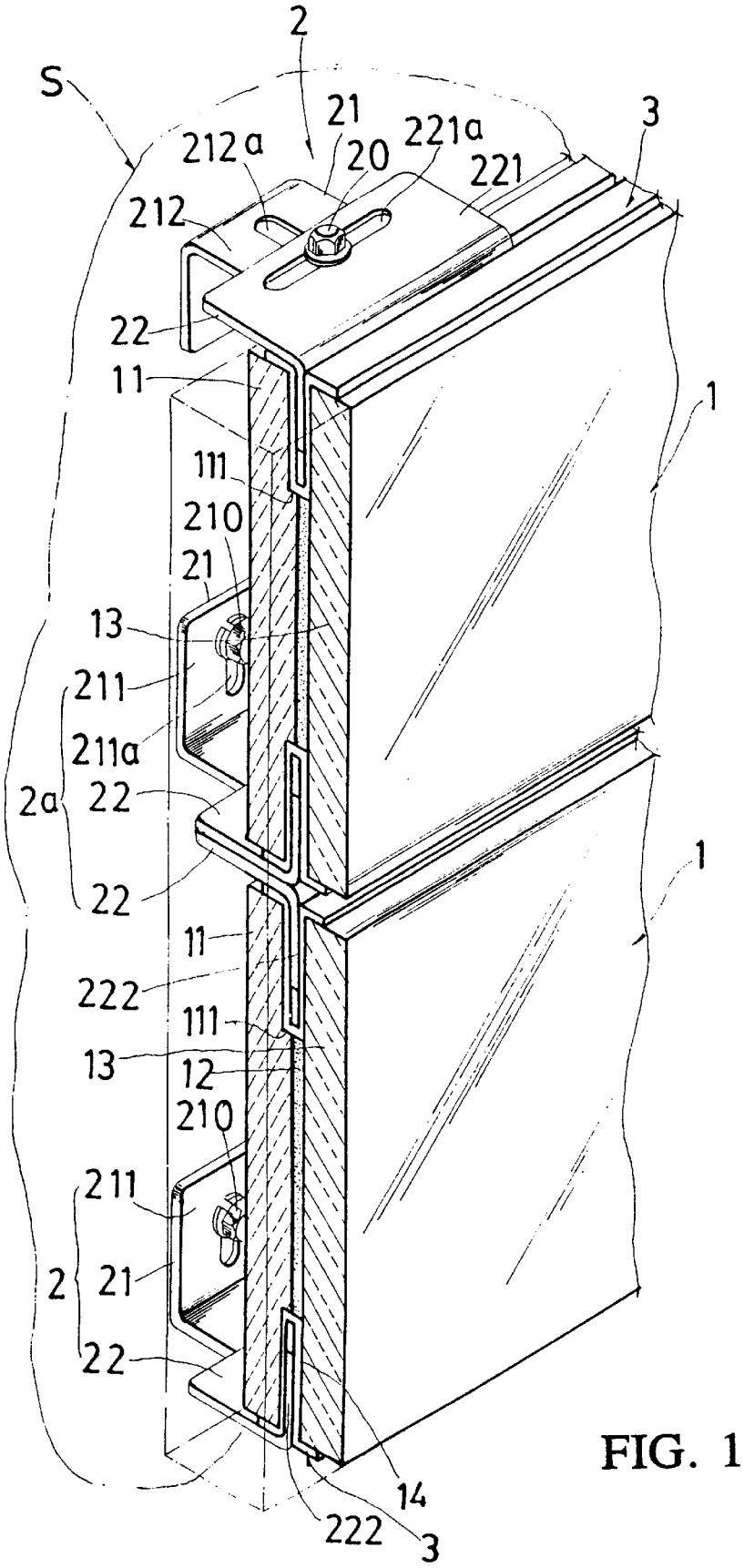
FIG. 1 is a perspective sectional view illustrating a prefabricated outer wall structure according to the present invention.

Please refer to FIGS. 1 thru 5, the present invention is related to a prefabricated outer wall structure with stress rupture resistance. The prefabricated outer wall structure is composed of a plurality of outer wall elements. Each outer wall element comprises a wall component (1) including an inner unit (11) and a plurality of fixing components (2). The inner unit (11) has a lateral slot (111) and its outer surface is adhered to an outer decorative wall unit (13) by means of adhesive (12) such as silicone in a manner that at least a retention slot (14) is defined between the ladder slot (111) and the outer decorative wall unit (14), and a U-plate (3) is placed within the retention slot (14). Each fixing component (2) is connected to at least a hook plate (22) corresponding to the U-plate (3) in the wall component (1), while an end of the fixing component (2) is secured to a construction structure (S) so that the wall component (1) is tightly secured to the construction structure (S).

The inner unit (11) of the said wall component (1) can be made of fire-proof material or other material. The outer decorative wall unit (12) can be made of reinforced fiberglass or other material. In the present invention there is no restriction on the material for the inner unit (11) and the outer decorative wall unit (12) the wall component (1), they can be made of any other material.

Figure 2:
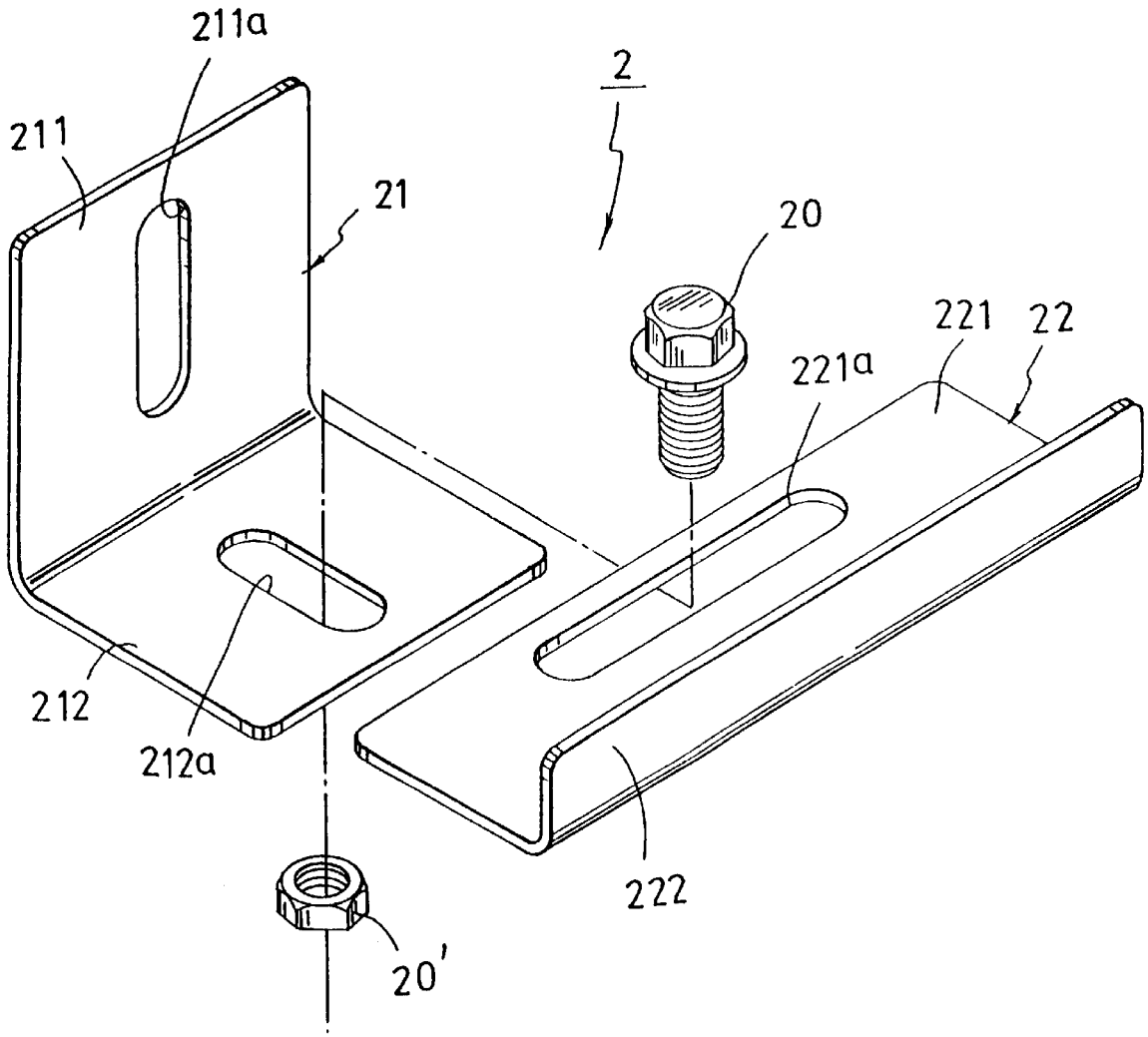
FIG. 2 is a developed view illustrating a fixing component according to the present invention.
Figure 3:
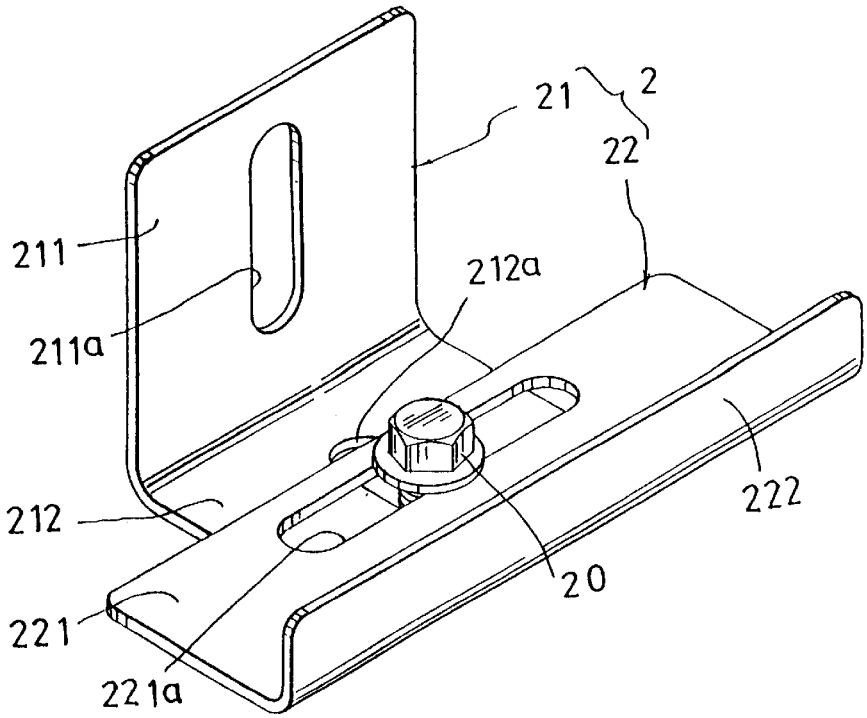
FIG. 3 is a perspective view illustrating an assembly of the fixing component according to the present invention.
Figure 4:
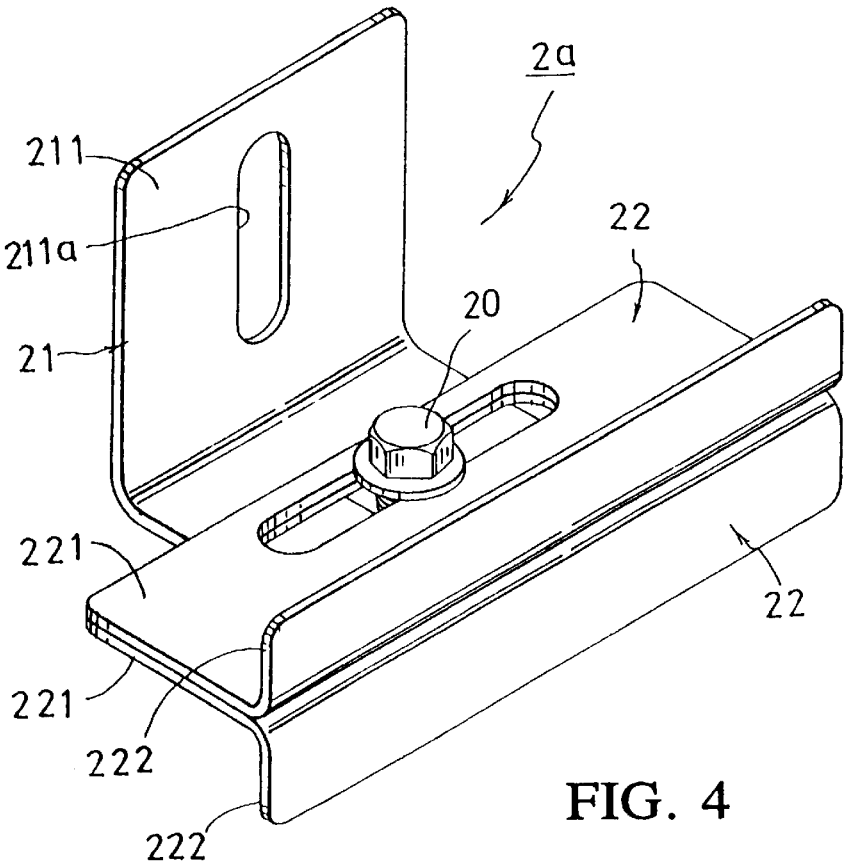
FIG. 4 is a perspective view of the fixing component fixed with two hook plates according to the present invention.

As shown in FIGS. 1 thru 3, the fixing component (2) disclosed in the present invention comprises a fixing plate (21) and a hook plate (22). The fixing plate (21) includes a fixing plate member (211) with at least a fixing hole **(211*a*) for passing thought of fastening member (210) such as bolt and plug for securing to the construction structure (S). A connecting plate member (212) is provided transversely at an edge of the fixing plate member (211). The connecting plate member (212) has at least a connecting hole (212*a*). The hook plate (22) includes a plate body (221) with at least a passing hole (221*a*) for securing to a connecting plate member (212) of the fixing plate (21). An end of the plate body (221) is provided with a hook plate member (222) extended radially corresponding to the U-plate (13) in the wall component (1)**.

The fixing hole **(211*a*) of the fixing plate member (211), the connecting hole (212*a*) of the connecting plate member (212), and the passing hole (221*a*) of the hook plate (22) can constitute a long hole while they are placed together to adjust the fixing location between the fixing plate (21) and the construction structure (S), or between the fixing plate (21) and the hook plate (22)**.

Figure 5:
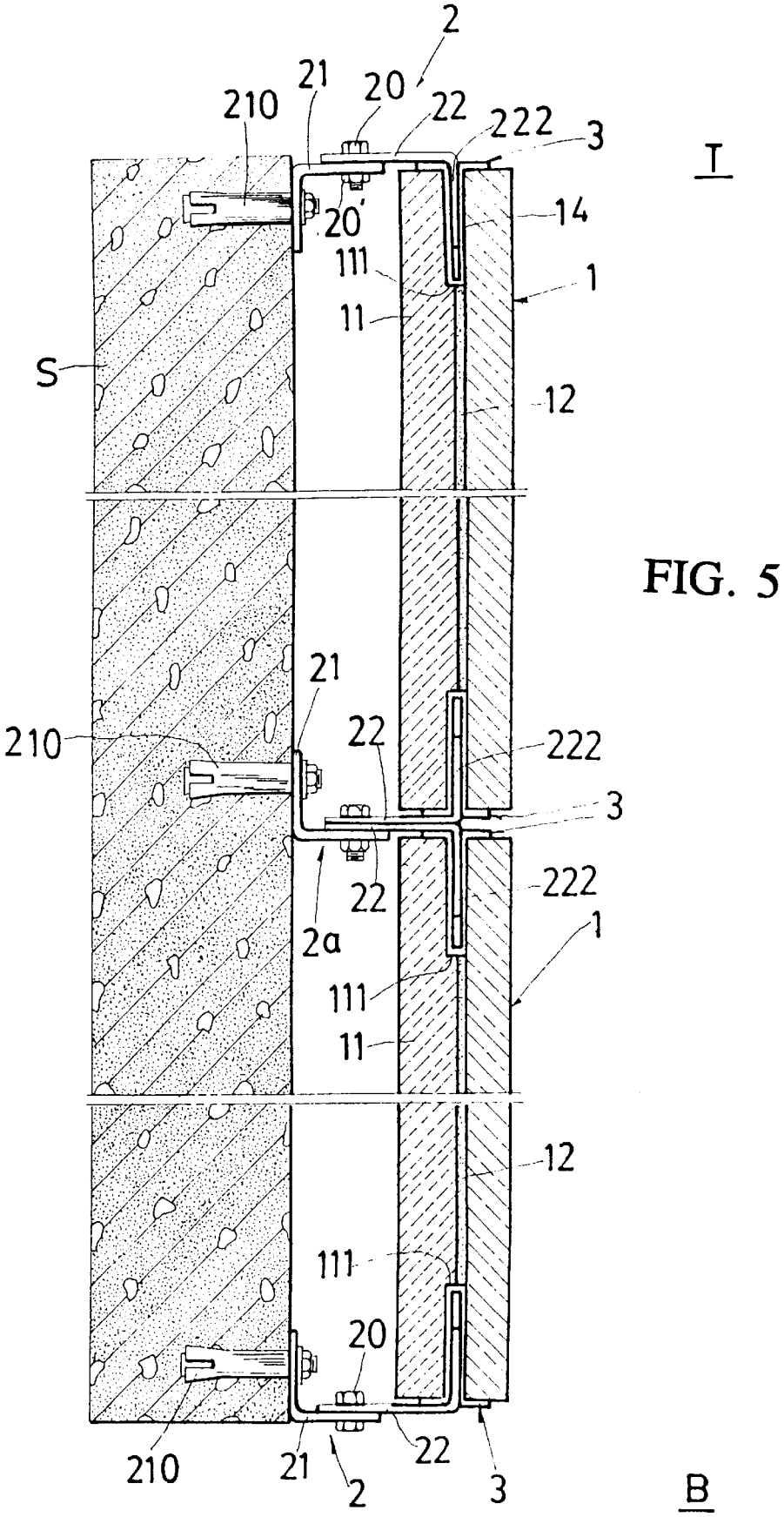
FIG. 5 is a partial side sectional view of the present invention.

The fixing component disclosed in the present invention can have only a hook plate (22), as required by the actual construction work, secured to the connecting plate member (212) of the fixing plate (21), as shown in FIGS. 2, 3 and 5 so that the fixing component (2) can be retained on the top U-plate (3) on the wall component (1) at the highest layer (T) of the outer wall of a construction, or the bottom U-plate (3) of the wall component (1) on the lowest layer (B) of the outer wall; or have two hook plates (22) secured to the respective connecting plate members (212) of the fixing plate (21) so that the plate bodies of these hook plates (22) are connected to each other with their respective hook plate members (222) extended outward in opposite directions, and consequently these two hook plate members (222) of the two hook plates (22) on the said fixing member (2*a*) can be retained at the U-plates (3) of their adjacent wall components (1) respectively for firm retention of the two adjacent wall components (1). In this way, the wall components are secured to the construction structure one by one to form the outer wall of the construction.

In fabrication of the present invention, the inner wall material (11) and the outer decorative wall unit (12) are adhered together by means of silicone (12). As silicone possesses an excellent adhesion property, in addition to the merit of easy application, it provides an excellent tensile strength between the inner unit (11) and the outer decorative wall unit. Moreover, silicone has good shock absorption and elastic buffer effect. Then, the present invention can absorb shock and buffer external force to minimize impact while it is subject to strong wind or other external force. This feature could prevent the wall component (1) from breakage, damage or falling down which might endanger public safety. It is also worth to mention that the prefabricated outer wall according to the present invention does not require milling and cutting of slot on the wall component (1) to prevent from concentration of stress and consequently avoid damage to the wall component (1), improve strength of the wall component effectively.

The outer decorative wall unit (13) of wall component (1), if made with transparent material such as reinforced fiberglass, can be attached with a shield 120 on its outer or inner surface to protect the silicone from direct exposure to sunlight in order to minimize aging of the silicone.

The description of aforesaid embodiments are intended to illustrate the means to achieve the objectives of the present invention, and they should not be applied to limit the conditions for any embodiment of the present invention. Many changes and modifications in the above described embodiment of the invention can, of course, be carried out without departing from the scope thereof. Hence, to promote the progress in science and the useful arts, the invention is disclosed and is intended to be limited only by the scope of the appended claims.

What is claimed is:

1. A prefabricated outer wall structure with stress rupture resistance comprising a plurality of outer wall elements, each outer wall element comprising: a wall component including an inner unit, an outer decorative wall unit, and a plurality of fixing components, the inner unit defining at least one lateral slot, along a portion of the remaining portion of the outer surface of said inner unit its outer surface being adhered to the inner surface of said outer decorative wall unit by an adhesive so that a retention slot is defined between the inner unit lateral slot and the outer decorative wall unit; a U-plate being placed in the retention slot; and each fixing component being connected to a hook plate engaged in a respective U-plate in the wall component, an end of the fixing component being secured to a construction structure so that the wall component is tightly secured to the construction structure.

2. A prefabricated outer wall structure with stress rupture resistance as claimed in claim 1 wherein the inner unit is made of fire-proof material and the outer decorative wall unit is made of reinforced fiberglass.

3. A prefabricated outer wall structure with stress rupture resistance as claimed in claim 1 wherein each fixing component comprises a fixing plate and at least a hook plate, the said fixing plate including a fixing plate member having a fixing hole therein for securing to the construction structure, a connecting plate member extending transversely to an edge of the fixing plate member, the connecting plate member having a connecting hole therethrough, each hook plate including a plate body, having a passing hole for securing said hook plate to a connecting plate member of the fixing plate, and an end of said hook plate having a hook plate member engaging a U-plate in the wall component.

4. A prefabricated outer wall structure with stress rupture resistance as claimed in claim 3 wherein the fixing hole of the fixing plate member, the connecting hole of the connecting plate member, and the passing hole of the hook plate are elliptical.

5. A prefabricated outer wall structure with stress rupture resistance as claimed in claim 1 wherein silicone is the adhesive which adheres the inner unit to the outer decorative wall unit.

6. A prefabricated outer wall structure with stress rupture resistance as claimed in claim 1 wherein a shield is placed between the outer decorative wall unit and the adhesive to protect the adhesive from direct exposure to sunlight.

* * * * *